US011840907B2

(12) United States Patent
Arnø-Kristoffersen

(10) Patent No.: US 11,840,907 B2
(45) Date of Patent: Dec. 12, 2023

(54) MODULE, A SYSTEM AND A METHOD FOR DAISY CHAINING OF SATELLITE WELLS

(71) Applicant: FMC Kongsberg Subsea AS, Kongsberg (NO)

(72) Inventor: Kristian Arnø-Kristoffersen, Drammen (NO)

( * ) Notice: Subject to any disclaimer, the term of this patent is extended or adjusted under 35 U.S.C. 154(b) by 0 days.

(21) Appl. No.: 17/776,576

(22) PCT Filed: Nov. 13, 2020

(86) PCT No.: PCT/EP2020/082130
§ 371 (c)(1),
(2) Date: May 12, 2022

(87) PCT Pub. No.: WO2021/094580
PCT Pub. Date: May 20, 2021

(65) Prior Publication Data

US 2022/0403715 A1 Dec. 22, 2022

(30) Foreign Application Priority Data

Nov. 13, 2019 (NO) ..... 20191343
Jun. 15, 2020 (NO) ..... 20200699

(51) Int. Cl.
*E21B 41/08* (2006.01)
*E21B 33/035* (2006.01)
(Continued)

(52) U.S. Cl.
CPC ..... *E21B 41/08* (2013.01); *E21B 33/035* (2013.01); *E21B 41/0007* (2013.01); *E21B 41/10* (2013.01); *E21B 43/017* (2013.01)

(58) Field of Classification Search
CPC .... E21B 33/035; E21B 41/08; E21B 41/0007; E21B 41/10; E21B 43/017
See application file for complete search history.

(56) References Cited

U.S. PATENT DOCUMENTS 3,934,658 A 1/1976 Nelson
4,036,295 A 7/1977 Kirkland et al.
(Continued)

FOREIGN PATENT DOCUMENTS

NO 20180011 A1 7/2019
WO WO 2017/209728 A1 12/2017
WO WO 2018/117861 A1 6/2018

*Primary Examiner* — Aaron L Lembo

(57) ABSTRACT

It is disclosed a satellite well structure (300) and method for expanding a subsea satellite well system. The subsea satellite well structure (300) comprising:—a seabed-based foundation (330) supporting a subsea wellhead (340);—a first landing position (310) configured to receive a Christmas tree module (200) for interfacing the subsea wellhead (340);—a second landing position (320) configured to receive a subsea connection module (100) for connecting the Christmas tree module (200) to a hydrocarbon fluid export flowline; and—a plurality of Christmas tree guide posts configured to support the installation of the Christmas tree module; wherein the first landing position has a landing envelope defined by the plurality of Christmas tree guide posts, and wherein the second landing positions is arranged offset the landing envelope of the first landing position, (allowing:—the subsea connection module (100) to be landed on and retrieved from the seabed-based well structure (300) with the Christmas tree module (200) landed in the first landing position (310); and—the Christmas tree module (200) to be landed on and retrieved from the seabed-based well structure (300) with the subsea connection module (100) landed in the second landing position (320).

8 Claims, 7 Drawing Sheets

(51) Int. Cl.

| | |
|---|---|
| ***E21B 41/10*** | (2006.01) |
| ***E21B 43/017*** | (2006.01) |
| ***E21B 41/00*** | (2006.01) |

(56) References Cited

U.S. PATENT DOCUMENTS

| | | | | |
|---|---|---|---|---|
| 4,625,806 | A | 12/1986 | Silcox | |
| 4,820,083 | A | 4/1989 | Hall | |
| 4,832,124 | A | 5/1989 | Davis | |
| 8,430,168 | B2 * | 4/2013 | Goodall | E21B 33/0385 166/344 |
| 11,236,589 | B2 * | 2/2022 | Rasmussen | E21B 33/038 |
| 2004/0140125 | A1 * | 7/2004 | Dezen | E21B 43/017 166/348 |
| 2008/0210432 | A1 * | 9/2008 | Crossley | E21B 43/0175 166/357 |
| 2010/0101799 | A1 | 4/2010 | Spencer et al. | |
| 2010/0200241 | A1 | 8/2010 | Ward | |
| 2018/0306007 | A1 | 10/2018 | Morrison et al. | |
| 2019/0323325 | A1 * | 10/2019 | Hestetun | E21B 41/08 |
| 2020/0003025 | A1 * | 1/2020 | Maher | E21B 41/04 |
| 2020/0123868 | A1 * | 4/2020 | Riley | E21B 34/04 |
| 2020/0198735 | A1 * | 6/2020 | Reinås | E02D 27/52 |
| 2020/0399980 | A1 * | 12/2020 | Spencer | E21B 34/04 |
| 2021/0054723 | A1 * | 2/2021 | Jacobsen | E21B 43/36 |
| 2021/0207456 | A1 * | 7/2021 | Vieira Borges | E21B 33/035 |

* cited by examiner

MODULE, A SYSTEM AND A METHOD FOR DAISY CHAINING OF SATELLITE WELLS

TECHNICAL FIELD

The present invention relates to a satellite well structure and a method for expanding a subsea satellite well system. In particular, the present invention relates to a well structure and a method for daisy chaining of subsea satellite production wells.

BACKGROUND

Generally, prior art solutions for daisy chaining of satellite fields require large investments. Some prior art solutions are performed by use of In-Line T's production pipeline or by the changing out a flow base of a satellite well with a new flow base and thereby allowing connection of an additional well to the export line. A flow base is located beneath the Christmas tree (XT). Therefore, the Christmas tree must be retrieved in order to retrieve the flow base to change it out, which is a costly process. Furthermore, since a flow base needs to be produced and installed during the initial field development, any future replacement flow base must also be considered during initial field development, thus increasing capital expenditure.

U.S. Pat. No. 4,036,295 A discloses a method and apparatus for connecting flowlines to underwater installations. The apparatus comprises a permanent guide base (PGB) with guide posts arranged in each of the four corners. A flowline base assembly comprising a main frame and a secondary frame can be landed on the PGB by guidance of the guide posts. The secondary frame is shiftable within a recess in the main frame and comprises two or more locator posts. A Christmas tree module can be landed on the main frame by guidance of the guide posts.

The Christmas tree module of U.S. Pat. No. 4,036,295 A is configured to not cover the secondary frame such that a flow base can be landed on and retrieved from the secondary frame while the Christmas tree is landed on the main frame. Modern Christmas tree modules normally cover the entire area between the guide posts, which makes it difficult to incorporate a secondary frame for landing a flow base as proposed by U.S. Pat. No. 4,036,295 A.

The secondary frame of U.S. Pat. No. 4,036,295 A is stroked towards the main frame to connect the flow base with the Christmas tree module. During this stroking, the flowline is held vertically extending from the PGB towards topside. After stroking, swivels on the flow base allow the flowlines to be laid on the seabed. However, the apparatus disclosed in U.S. Pat. No. 4,036,295 A is not adapted to allow for easy expansion of the system.

The present invention relates to a satellite well structure and a method that makes it possible to adapt satellite wells for daisy chaining of additional wells at any stage of the field life without retrieving the Christmas tree.

SUMMARY OF THE INVENTION

The invention provides a satellite well structure and a method for expanding a subsea satellite well system as set forth in the independent claims. Preferred embodiments are set forth in the dependent claims.

It is an objective of the present invention to provide a well structure and a method for daisy chaining of satellite wells which is improved regarding the above-identified disadvantages of the prior art.

According to a first aspect, a subsea satellite well structure is disclosed which comprises: a seabed-based foundation supporting a subsea wellhead; a first landing position configured to receive a Christmas tree module for interfacing the subsea wellhead; a second landing position configured to receive a subsea connection module for connecting the Christmas tree module to a hydrocarbon fluid export flowline; and a plurality of Christmas tree guide posts configured to support the installation of the Christmas tree module, wherein the first landing position has a landing envelope defined by the plurality of Christmas tree guide posts, and wherein the second landing positions is arranged offset from the landing envelope of the first landing position, thereby allowing: the subsea connection module to be landed on and retrieved from the seabed-based well structure with the Christmas tree module landed in the first landing position; and the Christmas tree module to be landed on and retrieved from the seabed-based well structure with the subsea connection module landed in the second landing position.

The first landing position defines a landing envelope for the Christmas tree, i.e. a space configured to receive the Christmas tree. Likewise, the second landing position defines a landing envelope for the subsea connection module, i.e. a space configured to receive the subsea connection module. The first landing position is configured to receive the Christmas tree and is arranged such that the Christmas tree landed therein can interface the subsea wellhead. The second landing position is configured to receive the subsea connection module and is arranged such that the subsea connection module landed therein can be connected to the Christmas tree landed in the first landing position. The first landing position and/or the second landing position may at least partly extend beyond a footprint of the seabed-based foundation.

The Christmas tree guide posts configured to support the installation of the Christmas tree module, i.e. guide the Christmas tree module during landing, may define the landing envelope for the Christmas tree module. In other words, imaginary rectilinear boundary lines extending between the guideposts may define an area or region corresponding to the landing envelope of the Christmas tree module and the landing position of the subsea connection module may be arranged non-overlapping or outside of this area.

The Christmas tree may be landed directly onto the well head and may not necessarily be in physical contact with the structures defining the first landing position although the first landing position defines the landing envelope of the Christmas tree, i.e. the space or position where the Christmas tree is to be landed.

Both the first landing position and the second landing position may have substantially vertical landing axes, i.e. axes along which the Christmas tree and the subsea connection module, respectably, are brought to dock with the subsea satellite well structure. These landing axes may further be substantially parallel.

Alternatively, the landing axes of the first landing position and the second landing position may have different orientations, e.g. substantially vertical, and/or arranged at an angle.

The first landing position may be substantially level with the second landing position. Alternatively, the second landing position could be positioned above the first landing position in the vertical direction, i.e. when seen from a side view, or vice versa.

The second landing position may be positioned at the side of the first landing position in the horizontal direction, i.e. when seen from a top view. In another alternative, the second landing position may fully or partially surround or encompass the first landing position in at least one plane. There may also be several second landing positions.

In particular, an advantage of the above-mentioned subsea satellite well structure is that it provides flexibility with regards to connecting additional or other wells to the same fluid export line/fluid injection line during the lifetime of fields with satellite production wells at a reduced cost level and also installation time. Hence, decisions on future expansion are not due in the early life of the field but could be decided and implemented at a later stage of the field's life.

A further advantage is that the subsea connection module can be retrieved with the Christmas tree module landed on the well structure, i.e. without retrieving the Christmas tree, and vice versa, which reduces time for connecting up an additional satellite well.

A further advantage is that the subsea connection module can be landed with the Christmas tree module already landed on the well structure, i.e. the subsea connection module can be landed on the well structure after the Christmas tree module has been landed on the well structure, and vice versa.

At least one of the subsea connection module and the Christmas tree module may comprise a flexible connection configured for interconnecting the Christmas tree module, when landed and installed in the first landing position, and the subsea connection module, when landed and installed in the second landing position. This will allow the Christmas tree module, when landed and installed in the first landing position, and the subsea connection module, when landed and installed in the second landing position, to be interconnected in a flexible manner allowing relative movement between the Christmas tree module and the subsea connection module when the subsea satellite well structure is in operation.

The flexible connection may, for example, be a flexible pipe or a flex loop.

As is known in the art, a flex loop comprises a pipe section that typically has a plurality of bends to avoid a straight-lined connection such that movements of the pipe section e.g. due to temperature changes, are elastically absorbed by the pipe section. The flex loop allows the first inlet to move relative to the rest of the subsea connection module. The flex loop will thus accommodate well growth.

Prior to connection of the Christmas tree and the subsea connection module, the flex loop may be provided on the Christmas tree or the subsea connection module.

When landed and installed in the second landing position, the subsea connection module may encircle the Christmas tree.

The second landing position may be configured to allow a first subsea connection module to be substituted for a second subsea connection module with the Christmas tree landed and installed in the first landing position, the first subsea connection module comprising an outlet for connection to said export flowline, and the second subsea connection module comprising an outlet for connection to said export flowline and an inlet for connection to a second, upstream satellite well structure.

The subsea satellite well structure may comprise at least one connection module guide post configured to support the installation of the connection module, e.g. guide the connection module during landing.

The first landing position may be adapted to receive a Christmas tree module configured for stroking connection with a stationary subsea connection module landed in the second landing position.

The second landing position may, in the vertical direction, be positioned higher than the first landing position. In other words, the second landing position may, in the vertical direction, be arranged at a level above the level in which the first landing position is arranged.

The first landing position may have a first landing axis and the second landing position may have a second landing axis that is parallel to the first landing axis.

According to a second aspect, a method of expanding a subsea satellite well system is disclosed, wherein the subsea satellite well system comprises: a first subsea satellite well structure according to said first aspect; a Christmas tree module comprising a production outlet and installed on a first landing position of the satellite well structure and connected to the wellhead; and a first subsea connection module installed on a second landing position of the satellite well structure, wherein the first subsea connection module comprises a first inlet being connected to the Christmas tree module and an outlet in fluid communication with the first inlet and connected to a downstream hydrocarbon fluid export flowline, wherein the method comprises the steps of: disconnecting the first subsea connection module from the downstream hydrocarbon fluid export flowline and the Christmas tree module; retrieving the first subsea connection module from the second landing position while the Christmas tree remains installed in the first landing position; landing and installing a second subsea connection module, comprising a first inlet, a second inlet and an outlet in fluid communication with each other, in the second landing position; connecting the first inlet of the second subsea connection module to the Christmas tree module by means of stroking the production outlet of the Christmas tree module towards the first inlet; connecting the outlet of the second subsea connection module to the downstream hydrocarbon fluid export flowline; and connecting the second inlet of the second subsea connection module to a second, upstream subsea satellite well structure.

The first subsea connection module may further comprise a first inlet valve arranged to control a fluid flow through the first inlet.

The second subsea connection module may further comprise a first inlet valve arranged to control a fluid flow through the first inlet.

The second subsea connection module may further comprise a second inlet valve arranged to control a fluid flow through the second inlet.

The second subsea connection module may further comprise a third inlet in fluid communication with the outlet and connectable to a third upstream subsea satellite well structure.

The second subsea connection module may further comprise a third inlet valve arranged to control a fluid flow through the third inlet. The subsea connection module may comprise at least one guide funnel configured for cooperating with a corresponding guide post on the satellite well structure allowing subsea positioning of the subsea connection module on the satellite well structure. Connecting the subsea connection module to the Christmas tree may be performed by horizontal stroking after landing the subsea connecting module onto the satellite well structure, thus dispensing with the need for mobilization of a tie in system at the Christmas tree end.

Preferably, the stroking is performed from the Christmas tree side such that the subsea connection module remains stationary after landing. This will guarantee the positional integrity of the landed connection module, thus facilitating attaching a flowline to the landed connection module. Also, if a flowline is connected to the connection module when stroking connection to the Christmas tree is performed, having a stationary connection module will prevent movement and tensioning of the flowline after landing the connection module on the subsea satellite structure.

The subsea satellite well structure may be adapted to support one or several Christmas trees.

The subsea satellite well structure may be adapted to support one or several subsea connection modules.

DESCRIPTION OF THE DRAWINGS

The following drawings are appended to facilitate the understanding of the present disclosure.

Figure 1:
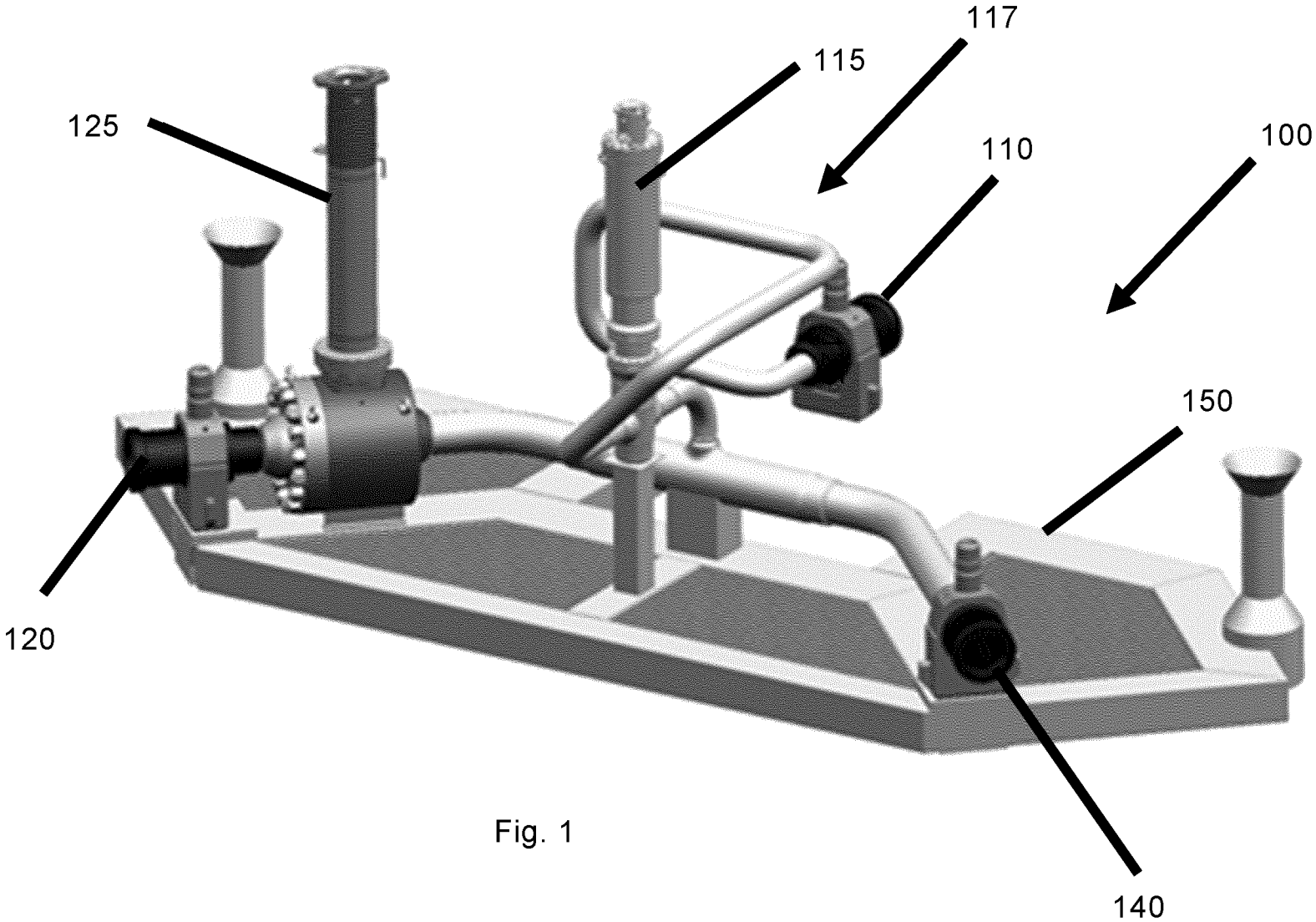
FIG. 1 shows a perspective view of a subsea connection module comprising a first outlet, a first inlet and a second inlet.

It should be understood, however, that the drawings are not intended to limit the invention to the subject-matter depicted in the drawings.

In the drawings, like reference numerals have been used to indicate common parts, elements or features unless otherwise explicitly stated or implicitly understood by the context.

DETAILED DESCRIPTION

Figure 2:
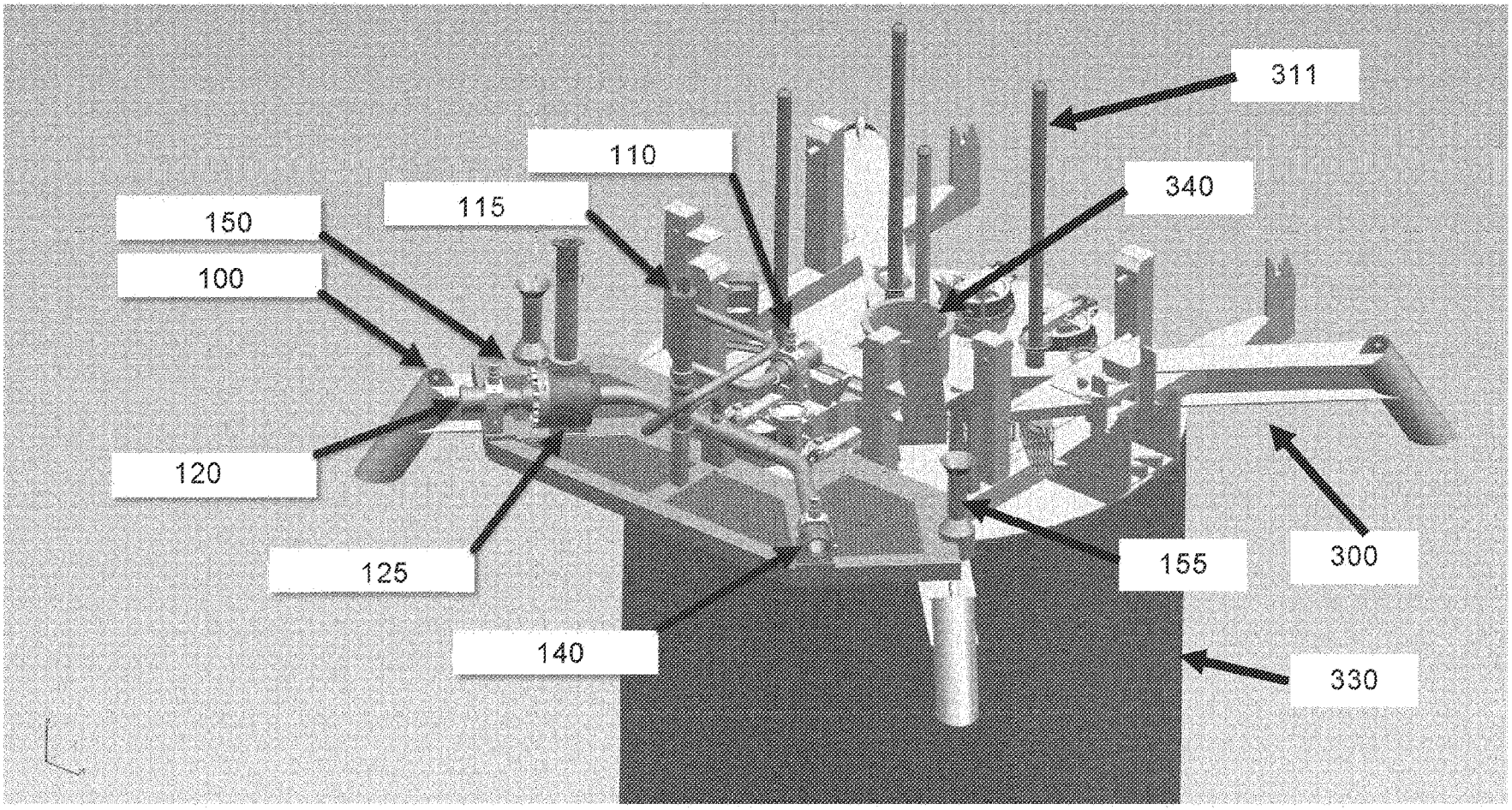
FIG. 2 shows a perspective view of the subsea connection module landed on a subsea satellite well structure.

FIG. 1 shows a perspective view of the subsea connection module 100 for landing, i.e. installation, on the subsea satellite well structure 300 (shown, e.g., in FIG. 2). The subsea connection module 100 comprises a support structure 150. The support structure 150 may be constructed of steel beams, rectangular tubes, pipes and/or expanded metal. The support structure 150 may support an outlet 140 connectable to a downstream hydrocarbon export flowline and a first inlet 110 in fluid communication with the outlet 140 and connectable to a Christmas tree (XT) 200. The outlet 140 and the first inlet 110 are communicating by means of piping.

Additionally, the support structure 150 may support a second inlet 120 in fluid communication with the outlet 140 and connectable to an upstream subsea satellite well structure through an upstream flowline. The second inlet 120 may also be in fluid communication with the first inlet 110.

The fluid flow through the first inlet 110 may be controlled by a first inlet valve 115 arranged downstream the first inlet 110. This first inlet valve 115 may also be supported by the support structure 150.

The fluid flow through the second inlet 120 may be controlled by a second inlet valve 125 downstream the second inlet 120. This second inlet valve 125 may also be supported by the support structure 150.

Additionally, further inlets (not illustrated) may be arranged in fluid communication with the outlet 140 and supported by the support structure 150. The fluid flow through any further inlets may be controlled by further inlet valves arranged downstream said inlets.

The first inlet valve 115, the second inlet valve 125 and/or any further valves may e.g. be ball valves or gate valves. These valves may be ROV operable, typically by means of a class 1-4 torque tool.

At least parts of the piping through which the first inlet 110 and the outlet 140 communicates may form a flex loop 117.

FIG. 2 shows a perspective view of the subsea connection module 100 landed on the subsea satellite well structure 300.

Figure 3:
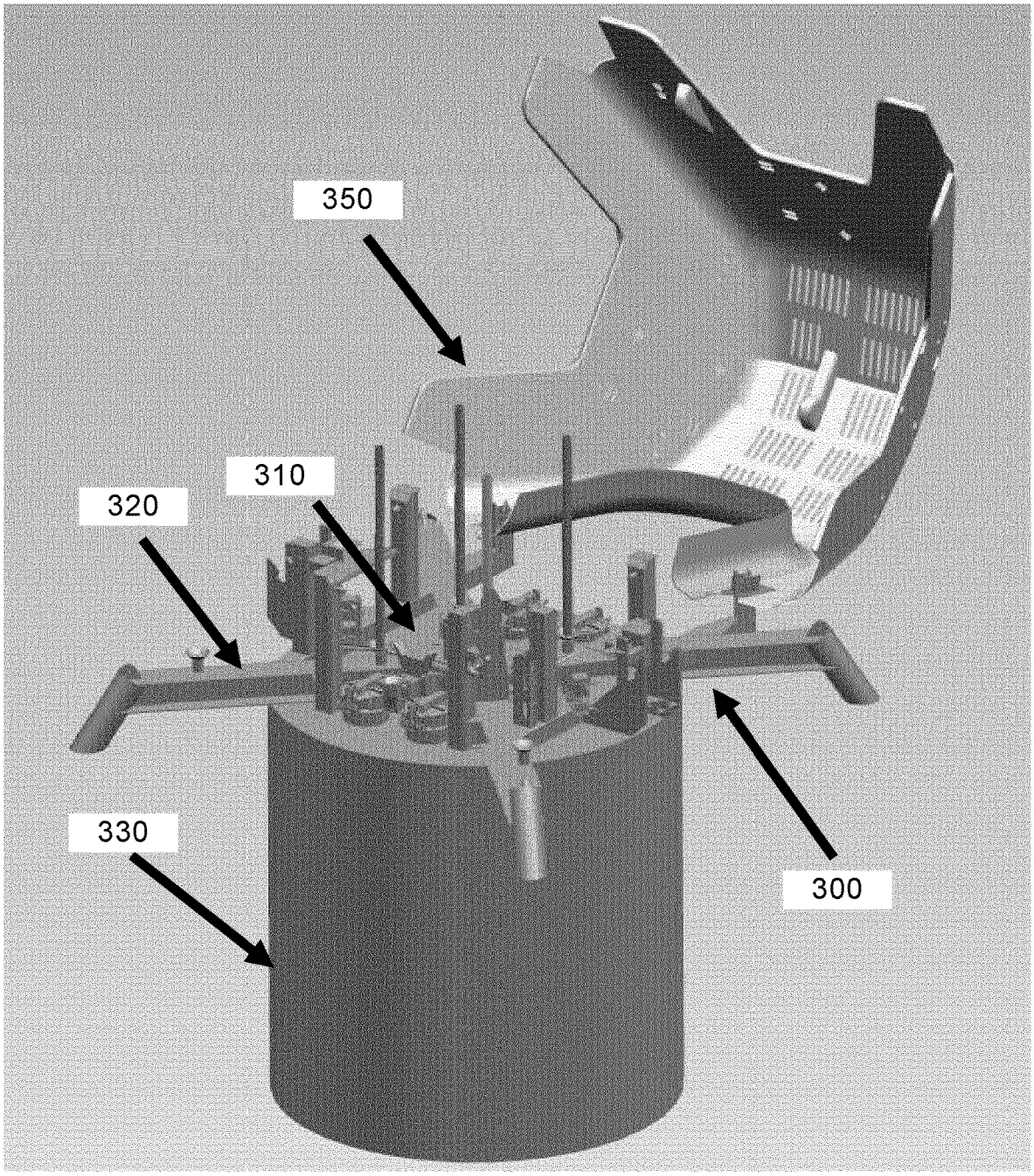
FIG. 3 shows a perspective view of a satellite well structure comprising a seabed-based foundation supporting a subsea wellhead.

The subsea connection module 100 comprises a support structure 150. The support structure 150 comprises positioning means 155 and subsea operable and releasable fastening means allowing the module 100 to be landed on and releasably attached to the satellite well structure 300. However, depending on the size and weight of the subsea connection module, it may be possible to land it on the support structure without physically locking it to the support structure, The support structure 150 illustrated in FIG. 2 is arranged to one side of the satellite well structure 300. The support structure 150 may be designed to extend to more than one side of the subsea satellite well structure 300. FIG. 3 shows a perspective view of the satellite well structure 300 provided on a seabed and comprising a seabed-based foundation 330, e.g. in the form of a suction anchor. The sea-based foundation 330 is configured to support a subsea wellhead 340 (see FIG. 2). The satellite well structure 300 is illustrated with a suction anchor; however, this is not essential for the invention. The satellite well structure 300 may alternatively comprise a mud mat. A framework may be arranged in an upper part of the subsea satellite structure 300, i.e. on top of the sea-based foundation 330. The framework may be used for connection of hatches 350 configured to cover and protect the subsea satellite well structure 300.

The subsea satellite well structure 300 comprises a first landing position 310 and a second landing position 320 arranged offset each other, i.e. arranged non-overlapping. The first and second landing positions 310, 320 may at least in part be formed or defined by the framework arranged on top of the seabed-based foundation 330.

The first landing position 310 defines a landing envelope for a Christmas tree 200 (shown, e.g., in FIG. 4), i.e. a space configured to receive the Christmas tree 200. The landing envelope for the Christmas tree 200 is defined by a plurality of Christmas tree guide posts arranged on the subsea satellite structure 300 to support the installation of the Christmas tree 200. Alternatively, the landing envelope for the Christmas tree 200 can be defined by a plurality of Christmas tree guide post receptacles arranged on the satellite well structure 300. In FIG. 2 four guideposts 311 define a rectangular landing envelope for the Christmas tree 200. In other words, imaginary rectilinear boundary lines extending between the guideposts 311 define an area or region corresponding to the landing envelope of the Christmas tree 200

Likewise, the second landing position 320 defines a landing envelope for the subsea connection module 100, i.e. a space configured to receive the subsea connection module 100. The landing envelope for the subsea connection module 100 is arranged offset the landing envelope for the Christmas tree 200. In other words, the landing position of the subsea connection module 100 is arranged non-overlapping or outside the landing envelope of the Christmas tree 200.

The first landing position 310 is configured to receive the Christmas tree 200 and is arranged such that the Christmas tree 200 landed therein can interface the subsea wellhead 340. The second landing position 320 is configured to receive the subsea connection module 100 and is arranged such that the subsea connection module 100 landed therein can be connected to the Christmas tree 200 landed in the first landing position 310. The first landing position 310 and/or the second landing position may at least partly extend beyond a footprint of the seabed-based foundation 330.

The Christmas tree 200 may be landed directly onto the well head and may not necessarily be in physical contact with the structures defining the first landing position 310 although the first landing position 310 defines the landing envelope of the Christmas tree 200, i.e. the space or position where the Christmas tree 200 is to be landed.

As illustrated in FIG. 3, both the first landing position 310 and the second landing position 320 may have substantially vertical landing axes, i.e. axes along which the Christmas tree 200 and the subsea connection module 100, respectably, are brought to dock with the subsea satellite well structure 300. These landing axes may further be substantially parallel.

Alternatively, the landing axes of the first landing position 310 and the second landing position 320 may have different orientations, e.g. substantially vertical, and/or arranged at an angle.

In FIG. 3, the first landing position 310 is substantially level with the second landing position 320. Alternatively, the second landing position 320 could be positioned above the first landing position 310 in the vertical direction, i.e. when seen from a side view, or vice versa.

In FIG. 3, the second landing position 320 is positioned at the side of the first landing position 310 in the horizontal direction, i.e. when seen from a top view.

The satellite well structure 300 may comprise at least one connection module guide post to support the installation of the subsea connection module 100 and/or at least one Christmas tree guide post to support the installation of the Christmas tree 200.

The connection module guide posts and the Christmas tree guideposts are preferably arranged on the same structure, as this will allow better control of dimensional tolerances.

Figure 4:
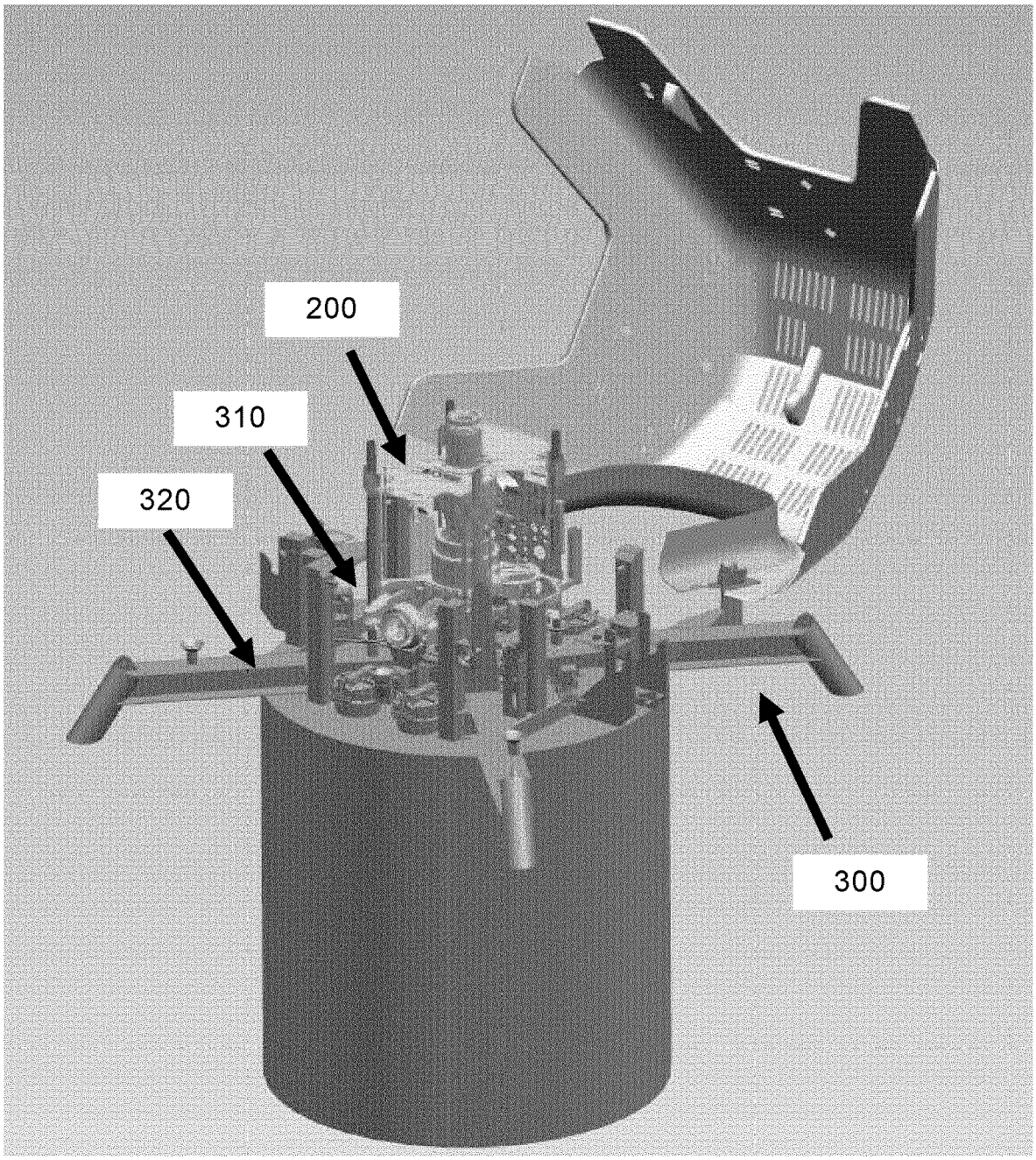
FIG. 4 shows a perspective view of a Christmas tree landed in a first landing position of the subsea satellite well structure.

The satellite well structure 300 is adapted to support at least one Christmas tree 200 and at least one subsea connection module 100. FIG. 4 shows a perspective view of a Christmas tree 200 landed in the first landing position 310 of the subsea satellite well structure 300. The subsea satellite well structure 300 may be adapted to support a plurality of Christmas trees 200. The Christmas tree 200 can be landed and installed in the first landing position 310 of the subsea satellite well structure 300 prior to landing and installing the subsea connection module 100 in the second landing position 320 of the subsea satellite well structure 300.

Figure 5:
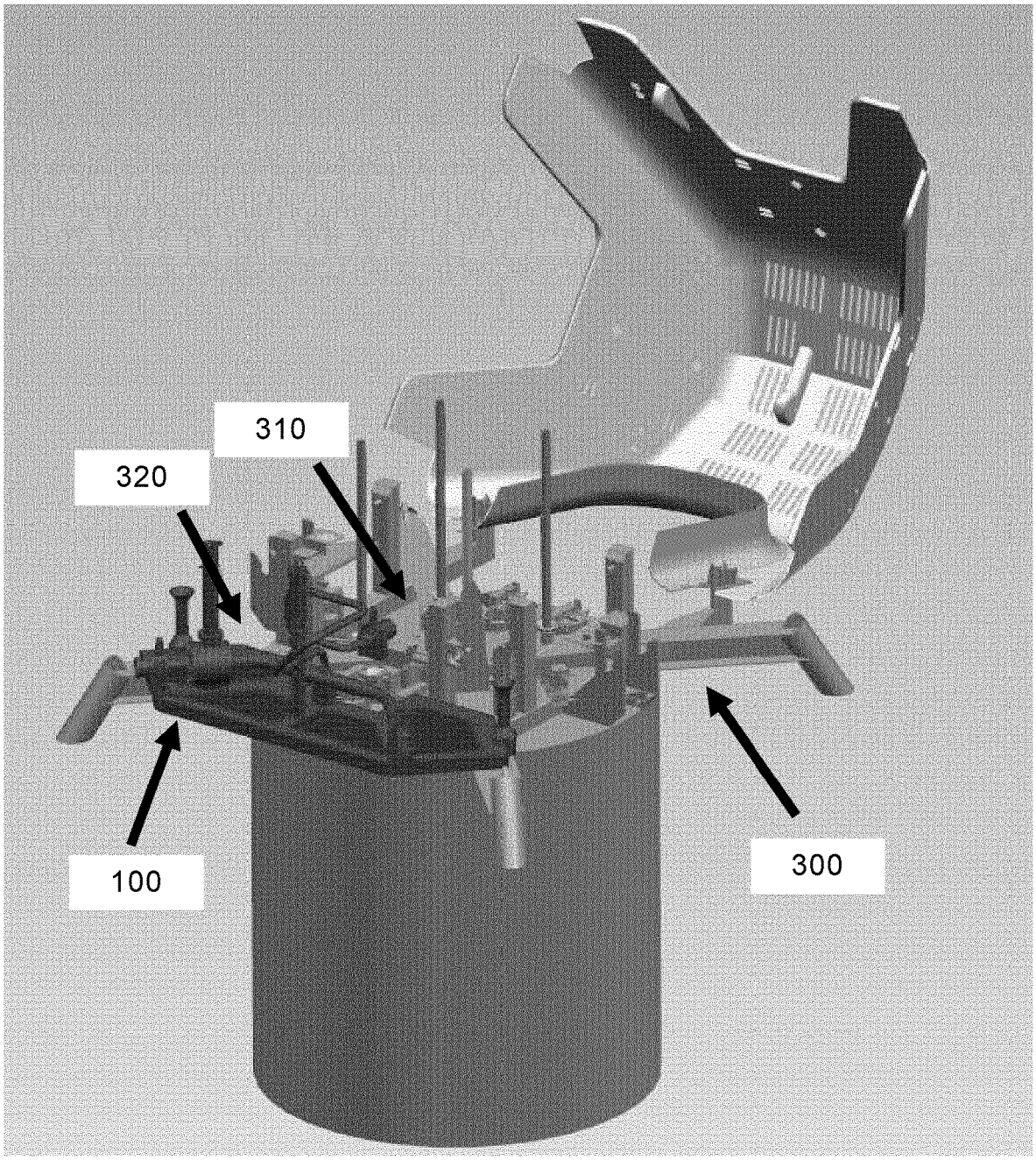
FIG. 5 shows a perspective view of the subsea connection module landed in a second landing position of the satellite well structure.

FIG. 5 shows a perspective view of the subsea connection module 100 landed on the subsea satellite well structure 300. The subsea satellite well structure 300 may be adapted to support a plurality of subsea connection modules 100. The subsea connection module 100 can be landed and installed in the second landing position 320 of the subsea satellite well structure 300 prior to landing and installing the Christmas tree 200 in the first landing position 310 of the satellite well structure 300.

Figure 6:
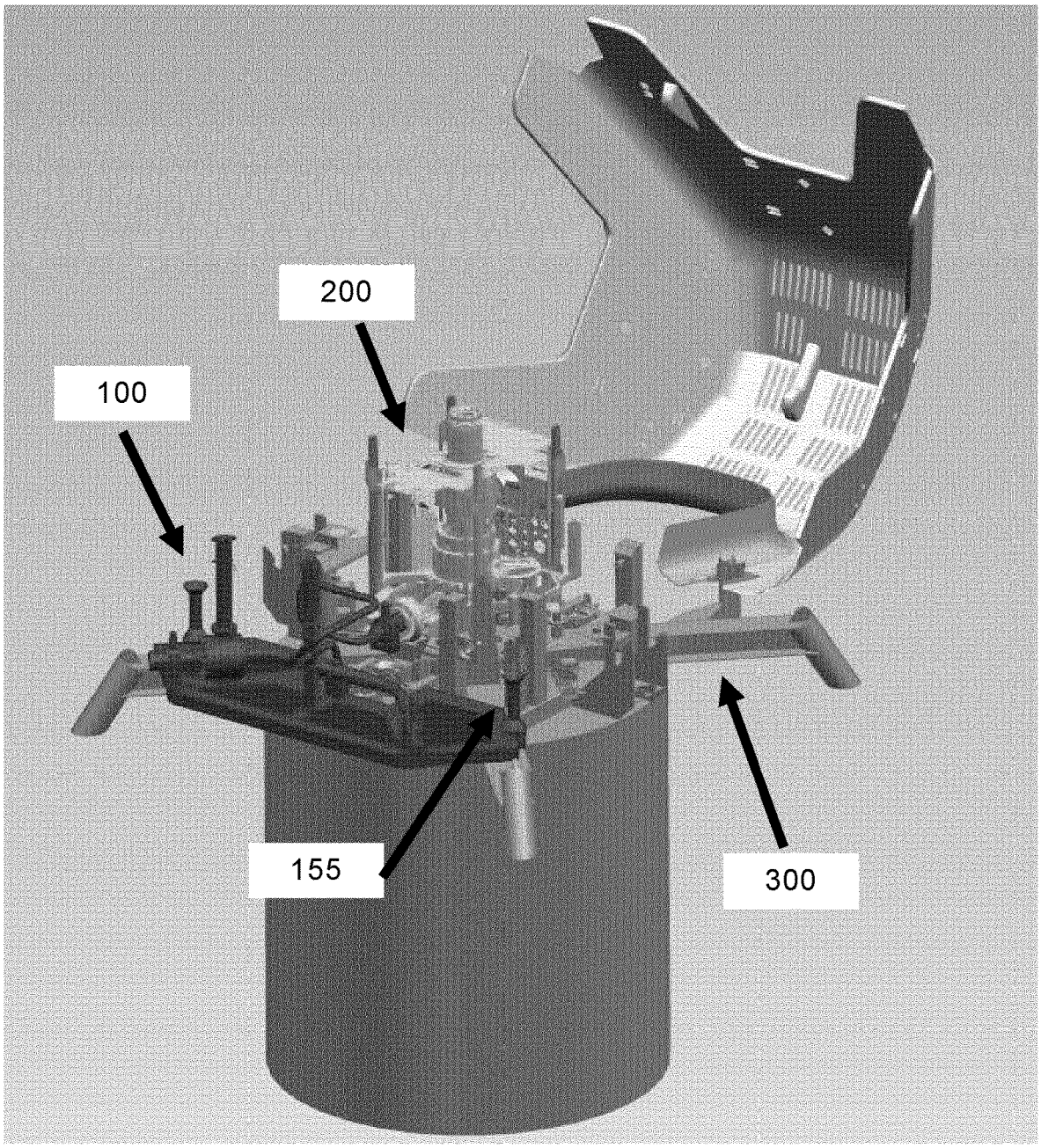
FIG. 6 shows a perspective view of the subsea connection module landed in the second landing position and a Christmas tree landed in the first landing position of the satellite well structure, where the Christmas tree is connected to the first inlet of the connection module.
Figure 7:
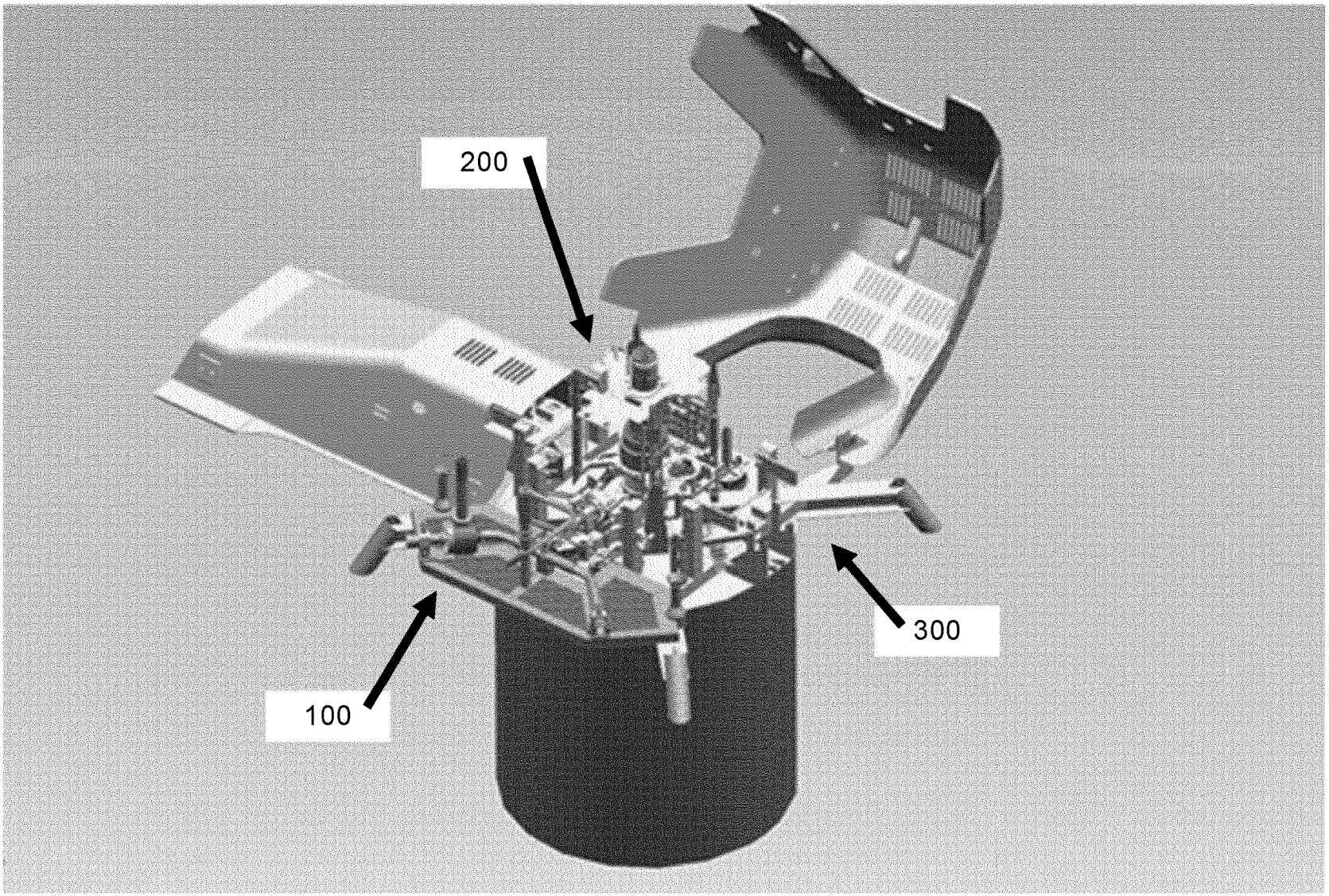
FIG. 7 shows a perspective view of the subsea connection module landed in the second landing position and a Christmas tree landed in the first landing position of the satellite well structure.

The positioning means 155 of the subsea connection module 100 may comprise at least one guide funnel configured for cooperating with the corresponding connection module guide post on the satellite well structure 300 allowing subsea positioning of the subsea connection module 100 on the satellite well structure 300. FIGS. 6 and 7 show different perspective views of the subsea connection module 100 and the Christmas tree 200 landed on the subsea satellite well structure 300. The Christmas tree 200 is landed in the first landing position 310 and connected to the subsea well head 340. The connection module 100 is landed in the second landing position 320.

The Christmas tree 200 can be landed and installed in the first landing position 310 of the subsea satellite well structure 300 after the subsea connection module 100 has been landed and installed in the second landing position 320 of the subsea satellite well structure 300.

The Christmas tree 200 and the connection module 100 are guided by respective guideposts during installation on the satellite well structure 300. This allows the Christmas tree 200 to be disconnected and retrieved from the first landing position 310 of the subsea satellite well structure 300 with the subsea connection module 100 installed in the second landing position 320 of the subsea satellite well structure 300, and the subsea connection module 100 to be landed and installed in the second landing position 320 of the subsea satellite well structure 300 after the Christmas tree 200 has been landed and installed in the first landing position 310 of the subsea satellite well structure 300.

The subsea connection module 100 can be disconnected and retrieved from the second landing position 320 of the subsea satellite well structure 300 with the Christmas tree 200 installed in the first landing position 310 of the subsea satellite well structure 300.

With the subsea connection module 100 and the Christmas tree 200 landed on the subsea satellite well structure 300, the Christmas tree 200 can be connected to the first inlet 110 of the subsea connection module 100. The connection of the Christmas tree 200 to the first inlet 110 of the subsea connection module 100 may be a standard tie-in connection, e.g. stroking two flanges together and ensuring sealing connection by means of at least one seal and one connector. The Christmas tree module 200 may comprise a production outlet that can be stroked towards the first inlet 110. This allows the connection module 100 to be stationary during connection with the Christmas tree module 200. Consequently, once landed on the subsea satellite well structure 300 the connection module 100 will remain stationary, thus guaranteeing the positional integrity of the landed connection module and facilitating attaching a flowline to the landed connection module 100. Also, if a flowline is connected to the connection module when stroking connection to the Christmas tree is performed, having a stationary connection module will prevent movement and tensioning of the flowline after landing the connection module 100 on the subsea satellite structure 300.

The Christmas tree 200 may comprise a flex loop for connecting to the first inlet 110 of the subsea connection module 100. Alternatively, or in addition, the subsea connection module 100 may comprise a flex loop for connecting to the Christmas tree 200. For example, the subsea connection module 100 may comprise a flex loop 117 arranged between the first inlet valve 115 and the first inlet 110 to accommodate movement of the Christmas tree 200, e.g. due to well growth. The disclosed flex loop 117 comprises six bends oriented in more than one plane.

A first flowline may be connected to the outlet 140 of the subsea connection module 100. The flowline connected to the outlet 140 of the subsea connection module 100 may provide downstream fluid communication, e.g. to a manifold, a riser, or another subsea connection module landed and installed on another satellite well structure. The well stream through the first inlet 110 of the subsea connection module 100, provided by the Christmas tree 200, may be controlled by means of the first inlet valve 115. The connection of the first flowline to the outlet 140 of the subsea connection module 100 may be a standard tie-in connection.

In a first phase of the subsea satellite system, the first subsea connection module 100 may not connect the subsea satellite structure 300 to a second, upstream subsea satellite structure 300. In that case, said first subsea connection module 100 may comprise the first inlet 110 and the outlet 140 and be connected to the Christmas tree 200 and the downstream flow line as described above.

If the subsea satellite well system is to be expanded in a second or subsequent phase, the first subsea connection module 100 may be replaced by a second subsea connection module 100 enabling connection of the first subsea satellite structure 300 to a second, upstream subsea satellite structure 300. The second subsea connection module 100 then additionally, as compared to the first subsea connection module 100, comprises a second inlet 120 for connection to the second, upstream subsea satellite well structure, typically through an upstream hydrocarbon fluid export flowline. The first inlet 110 and the outlet 140 of the first connection module 100 can be disconnected from the Christmas tree and the downstream flowline, respectively, and then the first connection module 100 can be retrieved from the second landing position 320 of the first subsea satellite well structure 300 while the Christmas tree 200 remains installed in the first landing position 310. The second subsea connection module 100 can be installed in the second landing position 320 of the first subsea satellite well structure 300 while the Christmas tree 200 remains installed in the first landing position 310. The first inlet 110 and the outlet 140 of the second subsea connection module 100 are connected to the Christmas tree and the downstream flowline, respectively, in a similar manner as for the first subsea connection module 100. The connection of the upstream flowline to the second inlet 120 of the second subsea connection module 100 may be a standard tie-in connection. Alternatively, the above-described second subsea connection module 100 could be installed instead of the first subsea connection module 100 during the first phase of the subsea satellite system. The replacement of the subsea connection module described above would then not be required. A second flowline may then be connected to the second inlet 120 of the subsea connection module 100. The flowline connected to the second inlet 120 of the subsea connection module may provide upstream fluid communication, e.g. to another Christmas tree or another subsea connection module 100 landed and installed on another satellite well structure. The well stream through the second inlet 120 of the subsea connection module 100, provided by the second flowline, may be controlled by means of the second inlet valve 125. The connection of the second flowline to the second inlet 120 of the subsea connection module 100 may be a standard tie-in connection. If no flowline is connected to the second inlet 120 of the subsea connection module 100, the second inlet valve 125 must be closed during production through the first inlet 110.

The subsea connection module 100 may comprise additional inlets for further connections, e.g. a third inlet provided with a third inlet valve.

The subsea connection module 100 is suitable for daisy chaining satellite wells and, according to one embodiment, the subsea connection module 100 may comprise a support structure 150 supporting:

- an outlet 140 connectable to a downstream flowline;
- a first inlet 110 in fluid communication with the outlet 140 and connectable to a Christmas tree 200;
- a second inlet 120 in fluid communication with the outlet 140 and connectable to an upstream flowline;
- a first inlet valve 115 arranged to control a fluid flow through the first inlet 110; and
- a second inlet valve 125 arranged to control a fluid flow through the second inlet 120.

The support structure 150 may comprise positioning means and subsea operable and releasable fastening means 155 allowing the subsea connection module 100 to be landed on and releasably attached to a satellite well structure 300.

The first inlet 110 of the subsea connection module 100 may be provided with a flex loop.

The subsea connection module 100 may further comprise:

- a third inlet in fluid communication with the outlet 140 and connectable to a second upstream flowline; and
- a third inlet valve arranged to control a fluid flow through the third inlet.

The positioning means 155 may comprise at least one guide funnel configured for cooperating with a corresponding guide post on the satellite well structure 300 allowing subsea positioning of the subsea connection module 100 on the satellite well structure 300.

According to one embodiment, the subsea connection module 100 may form part of a subsea connection system suitable for daisy chaining satellite wells.

The subsea connection system may comprise:

- a satellite well structure 300;
- a subsea connection module 100 of the above-mentioned type installed on the satellite well structure 300;
- at least one Christmas tree 200 installed on the satellite well structure 300 and connected to and in fluid communication with the first inlet 110 of the subsea connection module 100;
- at least a downstream flowline connected to and in fluid communication with the outlet 140 of the subsea connection module 100.

The subsea connection system may further comprise at least one guide post arranged on the satellite well structure 300 to support the installation of the subsea connection module 100.

The Christmas tree 200 may comprise a flex loop.

A method for daisy chaining satellite wells by using a subsea connection system may comprise the steps of:

- providing a satellite well structure 300 on a seabed;
- landing and installing a Christmas tree 200 on the satellite well structure 300;
- landing and installing a subsea connection module 100 on the satellite well structure 300, wherein the subsea connection module 100 comprises a support structure 150 supporting:

- an outlet 140 connectable to a downstream flowline;
- a first inlet 110 in fluid communication with the outlet 140 and connectable to a Christmas tree 200;
- a second inlet 120 in fluid communication with the outlet 140 and connectable to an upstream flowline;
- a first inlet valve 115 arranged to control a fluid flow through the first inlet 110; and a second inlet valve 125 arranged to control a fluid flow through the second inlet 120;

the method may further comprise the steps of:

connecting the Christmas tree 200 to the first inlet 110 of the subsea connection module 100;

providing said downstream flowline;

connecting the downstream flowline to the outlet 140 of the subsea connection module 100; and operating the first inlet valve 115 to control a fluid flow through the first inlet 110 of the subsea connection module 100.

The method may further comprise the steps of:

landing and installing the Christmas tree 200 on the satellite well structure 300 prior to landing and installing the subsea connection module 100 on the satellite well structure 300, or landing and installing the subsea connection module 100 on the satellite well structure 300 prior to landing and installing the Christmas tree 200 on the satellite well structure 300.

The method may further comprise the steps of:

providing an upstream flowline;

connecting the upstream flowline to the second inlet 120 of the subsea connection module 100; and operating the second inlet valve 125 to control a fluid flow through the second inlet 120 of the subsea connection module 100.

The invention claimed is:

1. A subsea satellite well structure comprising:

a seabed-based foundation supporting a subsea wellhead;

a first landing position configured to receive a Christmas tree module which is configured to interface with the subsea wellhead;

a second landing position configured to receive a subsea connection module which is configured to connect the Christmas tree module to a hydrocarbon fluid export flowline; and a plurality of Christmas tree guide posts configured to support the installation of the Christmas tree module;

wherein the first landing position has a landing envelope defined by the plurality of Christmas tree guide posts, and wherein the second landing position and the landing envelope of the first landing position are arranged non-overlapping to thereby allow:

the subsea connection module to be landed on and retrieved from the subsea satellite well structure with the Christmas tree module landed in the first landing position; and the Christmas tree module to be landed on and retrieved from the subsea satellite well structure with the subsea connection module landed in the second landing position.

2. The subsea satellite well structure according to claim 1, wherein at least one of the subsea connection module and the Christmas tree module comprises a flexible connection configured for interconnecting the Christmas tree module and the subsea connection module when the Christmas tree module is landed and installed in the first landing position and the subsea connection module is landed and installed in the second landing position, the flexible connection allowing relative movement between the Christmas tree module and the subsea connection module.

3. The subsea satellite well structure according to claim 1, wherein the second landing position is configured to allow a first subsea connection module to be substituted for a second subsea connection module with the Christmas tree module landed and installed in the first landing position, the first subsea connection module comprising an outlet for connection to said export flowline, and the second subsea connection module comprising an outlet for connection to said export flowline and an inlet for connection to a second, upstream satellite well structure.

4. The subsea satellite well structure according to claim 1, wherein the subsea satellite well structure further comprises:

at least one connection module guide post configured to support the installation of the connection module.

5. The subsea satellite well structure according to claim 1, wherein the first landing position is adapted to receive the Christmas tree module configured for stroking connection with the subsea connection module landed in the second landing position.

6. The subsea satellite well structure according to claim 1, wherein the second landing position is positioned higher than the first landing position in the vertical direction.

7. The subsea satellite well structure according to claim 1, wherein the first landing position has a first landing axis and the second landing position has a second landing axis that is parallel to the first landing axis.

8. A method of expanding a subsea satellite well system, wherein the subsea satellite system comprises:

a first subsea satellite well structure comprising a seabed-based foundation supporting a subsea wellhead, a first landing position, a second landing position and a plurality of Christmas tree guide posts which define a landing envelope of the first landing position, wherein the second landing position and the landing envelope of the first landing position are arranged non-overlapping;

a Christmas tree module comprising a production outlet, the Christmas tree module being installed on the first landing position of the satellite well structure and connected to the wellhead; and a first subsea connection module installed on the second landing position of the satellite well structure, the first subsea connection module comprising a first inlet connected to the Christmas tree module and an outlet in fluid communication with the first inlet and connected to a downstream hydrocarbon fluid export line;

wherein the method comprises the steps of:

disconnecting the first subsea connection module from the downstream hydrocarbon fluid export flowline and the Christmas tree module;

retrieving the first subsea connection module from the second landing position while the Christmas tree module remains installed in the first landing position;

landing and installing a second subsea connection module in the second landing position, the second subsea connection module comprising a first inlet, a second inlet and an outlet in fluid communication with each other;

connecting the first inlet of the second subsea connection module to the Christmas tree module by stroking the production outlet of the Christmas tree module towards the first inlet;

connecting the outlet of the second subsea connection module to the downstream hydrocarbon fluid export flowline; and connecting the second inlet of the second subsea connection module to a second, upstream subsea satellite well structure.

* * * * *